US010810954B2

(12) United States Patent
Chen

(10) Patent No.: US 10,810,954 B2
(45) Date of Patent: Oct. 20, 2020

(54) DRIVING METHOD AND DRIVING DEVICE FOR DRIVING A DISPLAY APPARATUS, AND DISPLAY APPARATUS

(71) Applicants: HKC Corporation Limited, Shenzhen, Guangdong (CN); CHONGQING HKC OPTOELECTRONICS TECHNOLOGY CO., LTD., Chongqing (CN)

(72) Inventor: Yu-Jen Chen, Guangdong (CN)

(73) Assignees: HKC Corporation Limited, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/462,547

(22) PCT Filed: Oct. 23, 2017

(86) PCT No.: PCT/CN2017/107210
§ 371 (c)(1),
(2) Date: May 21, 2019

(87) PCT Pub. No.: WO2018/113404
PCT Pub. Date: Jun. 28, 2018

(65) Prior Publication Data

US 2019/0348005 A1 Nov. 14, 2019

(30) Foreign Application Priority Data

Dec. 23, 2016 (CN) ..... 2016 1 1216238

(51) Int. Cl.
*G09G 3/36* (2006.01)

(52) U.S. Cl.
CPC ..... *G09G 3/3607* (2013.01); *G09G 3/3611* (2013.01); *G09G 2320/0242* (2013.01); *G09G 2360/16* (2013.01)

(58) Field of Classification Search
CPC ..... G09G 3/3607; G09G 3/3611; G09G 2360/16; G09G 2320/0242; G09G 3/2074; G09G 2320/028; G09G 2300/0447
See application file for complete search history.

(56) References Cited

U.S. PATENT DOCUMENTS

2006/0221030 A1* 10/2006 Shih ..... G09G 3/3611 345/88

FOREIGN PATENT DOCUMENTS

CN 101009083 A 8/2007

OTHER PUBLICATIONS

International Search Report of PCT Patent Application No. PCT/CN2017/107210 dated Jan. 19, 2018.

* cited by examiner

*Primary Examiner* — Carolyn R Edwards

(57) ABSTRACT

Disclosed are a driving method and a driving device for driving a display apparatus, as well as a display apparatus. The driving method includes: obtaining a first voltage driving signal and a second voltage driving signal of a sub-pixel of each of a plurality of pixels in an image; dividing each of all the sub pixels into two parts that are adjacent to each other with a stagger interval; and further dividing each of the parts into second luminescence signal values with the first luminescence signal values, where the second luminescence signal values and first luminescence signal values are adjacent to each other with a stagger interval, so as to control a display of the corresponding pixel.

12 Claims, 5 Drawing Sheets

| | | | | | | | | | |
|---|---|---|---|---|---|---|---|---|---|
| $R_1$ | $R_2$ | $R_3$ | $R_4$ | $R_5$ | $R_6$ | $R_7$ | $R_8$ | $R_9$ | $R_{10}$ |
| $R_{11}$ | $R_{12}$ | $R_{13}$ | $R_{14}$ | $R_{15}$ | $R_{16}$ | $R_{17}$ | $R_{18}$ | $R_{19}$ | $R_{20}$ |
| $R_{21}$ | $R_{22}$ | $R_{23}$ | $R_{24}$ | $R_{25}$ | $R_{26}$ | $R_{27}$ | $R_{28}$ | $R_{29}$ | $R_{30}$ |
| $R_{31}$ | $R_{32}$ | $R_{33}$ | $R_{34}$ | $R_{35}$ | $R_{36}$ | $R_{37}$ | $R_{38}$ | $R_{39}$ | $R_{40}$ |
| $R_{41}$ | $R_{42}$ | $R_{43}$ | $R_{44}$ | $R_{45}$ | $R_{46}$ | $R_{47}$ | $R_{48}$ | $R_{49}$ | $R_{50}$ |
| $R_{51}$ | $R_{52}$ | $R_{53}$ | $R_{54}$ | $R_{55}$ | $R_{56}$ | $R_{57}$ | $R_{58}$ | $R_{59}$ | $R_{60}$ |
| $R_{61}$ | $R_{62}$ | $R_{63}$ | $R_{64}$ | $R_{65}$ | $R_{66}$ | $R_{67}$ | $R_{68}$ | $R_{69}$ | $R_{70}$ |
| $R_{71}$ | $R_{72}$ | $R_{73}$ | $R_{74}$ | $R_{75}$ | $R_{76}$ | $R_{77}$ | $R_{78}$ | $R_{79}$ | $R_{80}$ |
| $R_{81}$ | $R_{82}$ | $R_{83}$ | $R_{84}$ | $R_{85}$ | $R_{86}$ | $R_{87}$ | $R_{88}$ | $R_{89}$ | $R_{90}$ |
| $R_{91}$ | $R_{92}$ | $R_{93}$ | $R_{94}$ | $R_{95}$ | $R_{96}$ | $R_{97}$ | $R_{98}$ | $R_{99}$ | $R_{100}$ |

FIG. 3

| | | | | | | | | | |
|---|---|---|---|---|---|---|---|---|---|
| H1 | H2 | H3 | H4 | H5 | H6 | H7 | H8 | H9 | H10 |
| H11 | H12 | H13 | H14 | H15 | H16 | H17 | H18 | H19 | H20 |
| H21 | H22 | H23 | H24 | H25 | H26 | H27 | H28 | H29 | H30 |
| H31 | H32 | H33 | H34 | H35 | H36 | H37 | H38 | H39 | H40 |
| H41 | H42 | H43 | H44 | H45 | H46 | H47 | H48 | H49 | H50 |
| H51 | H52 | H53 | H54 | H55 | H56 | H57 | H58 | H59 | H60 |
| H61 | H62 | H63 | H64 | H65 | H66 | H67 | H68 | H69 | H70 |
| H71 | H72 | H73 | H74 | H75 | H76 | H77 | H78 | H79 | H80 |
| H81 | H82 | H83 | H84 | H85 | H86 | H87 | H88 | H89 | H90 |
| H91 | H92 | H93 | H94 | H95 | H96 | H97 | H98 | H99 | H100 |

FIG. 4

| | | | | | | | | | |
|---|---|---|---|---|---|---|---|---|---|
| L1 | L2 | L3 | L4 | L5 | L6 | L7 | L8 | L9 | L10 |
| L11 | L12 | L13 | L14 | L15 | L16 | L17 | L18 | L19 | L20 |
| L21 | L22 | L23 | L24 | L25 | L26 | L27 | L28 | L29 | L30 |
| L31 | L32 | L33 | L34 | L35 | L36 | L37 | L38 | L39 | L40 |
| L41 | L42 | L43 | L44 | L45 | L46 | L47 | L48 | L49 | L50 |
| L51 | L52 | L53 | L54 | L55 | L56 | L57 | L58 | L59 | L60 |
| L61 | L62 | L63 | L64 | L65 | L66 | L67 | L68 | L69 | L70 |
| L71 | L72 | L73 | L74 | L75 | L76 | L77 | L78 | L79 | L80 |
| L81 | L82 | L83 | L84 | L85 | L86 | L87 | L88 | L89 | L90 |
| L91 | L92 | L93 | L94 | L95 | L96 | L97 | L98 | L99 | L100 |

FIG. 5

| | | | | | | | | | |
|---|---|---|---|---|---|---|---|---|---|
| H'1 | L'2 | H'3 | L'4 | H'5 | L'6 | H'7 | L'8 | H'9 | L'10 |
| L'11 | H'12 | L'13 | H'14 | L'15 | H'16 | L'17 | H'18 | L'19 | H'20 |
| H'21 | L'22 | H'23 | L'24 | H'25 | L'26 | H'27 | L'28 | H'29 | L'30 |
| L'31 | H'32 | L'33 | H'34 | L'35 | H'36 | L'37 | H'38 | L'39 | H'40 |
| H'41 | L'42 | H'43 | L'44 | H'45 | L'46 | H'47 | L'48 | H'49 | L'50 |
| L'51 | H'52 | L'53 | H'54 | L'55 | H'56 | L'57 | H'58 | L'59 | H'60 |
| H'61 | L'62 | H'63 | L'64 | H'65 | L'66 | H'67 | L'68 | H'69 | L'70 |
| L'71 | H'72 | L'73 | H'74 | L'75 | H'76 | L'77 | H'78 | L'79 | H'80 |
| H'81 | L'82 | H'83 | L'84 | H'85 | L'86 | H'87 | L'88 | H'89 | L'90 |
| L'91 | H'92 | L'93 | H'94 | L'95 | H'96 | L'97 | H'98 | L'99 | H'100 |

FIG. 6

DRIVING METHOD AND DRIVING DEVICE FOR DRIVING A DISPLAY APPARATUS, AND DISPLAY APPARATUS

TECHNICAL FIELD

This application relates generally to liquid crystal display technology, and more particularly relates to a driving method and a driving device for driving a display apparatus, as well as a display apparatus.

BACKGROUND

Most existing large-sized liquid crystal display panels adopt the passive VA (vertical alignment) or IPS (in-plane switching) liquid crystal technology. Compared with the IPS liquid crystal technology, the VA liquid crystal technology has the advantages of high production efficiency and low manufacturing cost; but it has obvious defects in optical properties compared with the IPS liquid crystal technology. In particular, large-sized panels in general commercial applications require a relatively large viewing angle, but the VA-type liquid crystal driving often cannot meet the requirements of general market applications when it comes to the angular color shift issue, which negatively affects the promotion of the VA liquid crystal technology.

In the VA liquid crystal technology the typical solution to angular color shift consists in subdividing each of various RGB primary color pixels into a primary pixel and a secondary pixel and feeding different driving voltages to the primary and secondary pixels which are spatially arranged, hopefully remedying the defect of angular color shift. Such a pixels design, however, typically requires redesigning metal wires and thin film transistors for purposes of driving the secondary pixels, resulting in a sacrifice of the light-transmissive opening area, thus negatively affecting the panel's transmittance and leading to a direct increase in the cost of the backlight module.

SUMMARY

This application provides a computing-device-implemented driving method for driving a display apparatus, which can reduce the angular color shift while improving the panel's transmittance and reducing the cost of the backlight module.

The computing-device-implemented driving method for driving a display apparatus provided by this application includes: receiving, by a processing module, an image to be displayed, obtaining a pixel signal and associated positional information of each of a plurality of pixels, and looking up the pixel signal to retrieve a first voltage driving signal and a second voltage driving signal of a sub-pixel of each of the plurality of pixels; determining whether the sub-pixel of each of the plurality of pixels is a first-position sub-pixel or a second-position sub-pixel based on the positional information; when the sub-pixel is a first-position sub-pixel, computing a second luminance signal based on the second voltage driving signal of the first-position sub-pixel and that of at least one second-position sub-pixel adjacent to the first-position sub-pixel; otherwise when the sub-pixel is a second-position sub-pixel, computing a first luminance signal based on the first voltage driving signal of the second-position sub-pixel and that of at least one first-position sub-pixel adjacent to the second-position sub-pixel; and driving the first-position sub-pixel using the second luminance signal, and driving the second-position sub-pixel using the first luminance signal.

In one embodiment, computing the first luminance signal when the sub-pixel is a second-position sub-pixel comprises substituting relevant parameters into the following formula to compute the first luminance signal;

$$L'_{nm}=a*L_{nm}+b*(L_{n(m-1)}+L_{n(m+1)}+L_{(n-1)m}+L_{(n+1)m});$$

where n represents row position information of the second-position sub-pixel in a panel, m represents column position information of the second-position sub-pixel in the panel, and a and b represent weight factors; $L_{nm}$ and $L'_{nm}$ respectively represent the first voltage driving signal and the first luminance signal of the second-position sub-pixel; and $L_{n(m-1)}$, $L_{n(m+1)}$, $L_{(n-1)m}$, and $L_{(n+1)m}$ respectively represent the first voltage driving signals of the first-position sub-pixels adjacent to the second-position sub-pixel.

In one embodiment, computing the second luminance signal when the sub-pixel is a first-position sub-pixel comprises substituting relevant parameters into the following formula to compute the second luminance signal;

$$H'_{nm}=a*H_{nm}+b*(H_{n(m-1)}+H_{n(m+1)}+H_{(n-1)m}+H_{(n+1)m});$$

where n represents row position information of the first-position sub-pixel in a panel, m represents column position information of the first-position sub-pixel in the panel, and a and b represent weight factors; $H_{nm}$ and $H'_{nm}$ respectively represent the second voltage driving signal and the second luminance signal of the first-position sub-pixel; and $H_{n(m-1)}$, $H_{n(m+1)}$, $H_{(n-1)m}$, and $H_{(n+1)m}$ respectively represent the second voltage driving signals of the second-position sub-pixels adjacent to the first-position sub-pixel.

In one embodiment, the weight factor a has a value of 1 and the weight factor b has a value of 0.25.

In one embodiment, the driving method further includes: when in computing the first luminance signal or the second luminance signal using the formula a corresponding pixel position of the first-position sub-pixel or the second-position sub-pixel in the formula doesn't exist in the panel, writing the corresponding first voltage driving signal or second voltage driving signal of the non-existent pixel position as 0.

The present application further provides a driving device for driving a display apparatus, the driving apparatus including a storage module storing one or more executable instructions and a processing module configured to execute the one or more executable instructions, the one or more executable instructions including: a signal acquisition module configured to receive an image to be displayed, obtain a pixel signal and associated positional information of each of a plurality of pixels, and look up the pixel signal to retrieve a first voltage driving signal and a second voltage driving signal of a sub-pixel of each of the plurality of pixels; a position determination module configured to determine whether the sub-pixel of each of the plurality of pixels is a first-position sub-pixel or a second-position sub-pixel based on the positional information; a second luminance signal computation module configured to compute, when the sub-pixel is a first-position sub-pixel, a second luminance signal based on the second voltage driving signal of the first-position sub-pixel and that of at least one second-position sub-pixel adjacent to the first-position sub-pixel; a first luminance signal computation module configured to compute, when the sub-pixel is a second-position sub-pixel, a first luminance signal based on the first voltage driving signal of the second-position sub-pixel and that of at least one first-position sub-pixel adjacent to the second-position sub-pixel; and a driving module configured to drive the first-position sub-pixel using the second luminance signal and drive the second-position sub-pixel using the first luminance signal.

In one embodiment, the first luminance signal computation module is configured to substitute relevant parameters into the following formula to compute the first luminance signal:

$$L'_{nm}=a*L_{nm}+b*(L_{n(m-1)}+L_{n(m+1)}+L_{(n-1)m}+L_{(n+1)m});$$

where n represents row position information of the second-position sub-pixel in a panel, m represents column position information of the second-position sub-pixel in the panel, and a and b represent weight factors; $L_{nm}$ and $L'_{nm}$ respectively represent the first voltage driving signal and the first luminance signal of the second-position sub-pixel; and $L_{n(m-1)}$, $L_{n(m+1)}$, $L_{(n-1)m}$, and $L_{(n+1)m}$, respectively represent the first voltage driving signals of the first-position sub-pixels adjacent to the second-position sub-pixel.

In one embodiment, the weight factor a has a value of 1 and the weight factor b has a value of 0.25.

In one embodiment, the second luminance signal computation module is configured to substitute relevant parameters into the following formula to compute the second luminance signal:

$$H'_{nm}=a*H_{n(m-1)}+H_{n(m+1)}+H_{(n-1)m}+H_{(n+1)m});$$

where n represents row position information of the first-position sub-pixel in a panel, m represents column position information of the first-position sub-pixel in the panel, and a and b represent weight factors; $H_{nm}$ and $H'_{nm}$ respectively represent the second voltage driving signal and the second luminance signal of the first-position sub-pixel; and $H_{n(n-1)}$, $H_{n(m+1)}$, $H_{(n-1)m}$, and $H_{(n+1)m}$ respectively represent the second voltage driving signals of the second-position sub-pixels adjacent to the first-position sub-pixel.

In one embodiment, when in computing the first luminance signal or the second luminance signal using the formula a corresponding pixel position of the first-position sub-pixel or the second-position sub-pixel in the formula doesn't exist in the panel, the corresponding first voltage driving signal or second voltage driving signal of the non-existent pixel position would be written as 0.

This application further provides a display apparatus which includes the above-mentioned driving device for driving a display apparatus.

According to this application, by: receiving an image to be displayed, obtaining a pixel signal and associated positional information of each of a plurality of pixels, and looking up the pixel signal to retrieve a first voltage driving signal and a second voltage driving signal of a sub-pixel of each of the plurality of pixels; determining whether the sub-pixel of each of the plurality of pixels is a first-position sub-pixel or a second-position sub-pixel based on the positional information; computing a second luminance signal based on the second voltage driving signal of the first-position sub-pixel and that of at least one second-position sub-pixel adjacent to the first-position sub-pixel; and computing a first luminance signal based on the first voltage driving signal of the second-position sub-pixel and that of at least one first-position sub-pixel adjacent to the second-position sub-pixel; finally driving the first-position sub-pixel using the second luminance signal, and driving the second-position sub-pixel using the first luminance signal, controlling the sub-pixels displayed in a same frame.

In addition, technical solutions according to this application don't need to set primary pixels and secondary pixels, so there is no need to design metal wires or thin film transistors to drive the secondary pixels. This simplifies the manufacturing process and reduces the cost. The panel's transmittance is also improved due to the elimination of the secondary pixels.

BRIEF DESCRIPTION OF THE ACCOMPANYING DRAWINGS

To better illustrate the technical solutions that are reflected in various embodiments according to this application or that are found in the prior art, the accompanying drawings required for the description of the embodiments herein or of the prior art will now be briefly described. It is evident that the accompanying drawings listed in the following description show merely some embodiments of this application, and that those having ordinary skill in the art will be able to obtain other drawings based on the arrangements shown in these drawings without making creative efforts, where in the drawings:

FIG. 3 is a schematic diagram illustrating the distribution of luminance signals of a part of R sub-pixels;

FIG. 4 is a schematic diagram illustrating the distribution of second voltage driving signals of a part of R sub-pixels;

FIG. 5 is a schematic diagram illustrating the distribution of first voltage driving signals of a part of R sub-pixels;

FIG. 6 is a schematic diagram illustrating the distribution of second luminance signals and first luminance signals of a part of R sub-pixels.

DETAILED DESCRIPTION OF ILLUSTRATIVE EMBODIMENTS

It will be appreciated that the embodiments described herein are merely illustrative of the application and are not intended to limit the application. Technical solutions embodied in the embodiments of this application will now be clearly and comprehensively described in connection with the accompanying drawings intended for these embodiments. Apparently, the described embodiments are merely some rather than all of the embodiments of this application. All other embodiments obtained by persons having ordinary skill in the art based on the embodiments of this application without making inventive efforts shall all fall within the scope of protection of this application.

As used herein, terms such as "first" or "second" are intended for illustrative purposes only and are not to be construed as indicating or implying their relative importance or implicitly indicating the number of the specified technical features. Thus, a feature defined by terms such as "first" or "second" may explicitly or implicitly include at least one of such a feature. Additionally, technical solutions of various embodiments may be combined with one another; but such combinations must be premised on the achievability to those having ordinary skill in the art. Where a combination of technical solutions ends up contradictory or unachievable, such a combination shall be regarded as non-existent nor would it fall within the scope of protection of this application.

Figure 1:
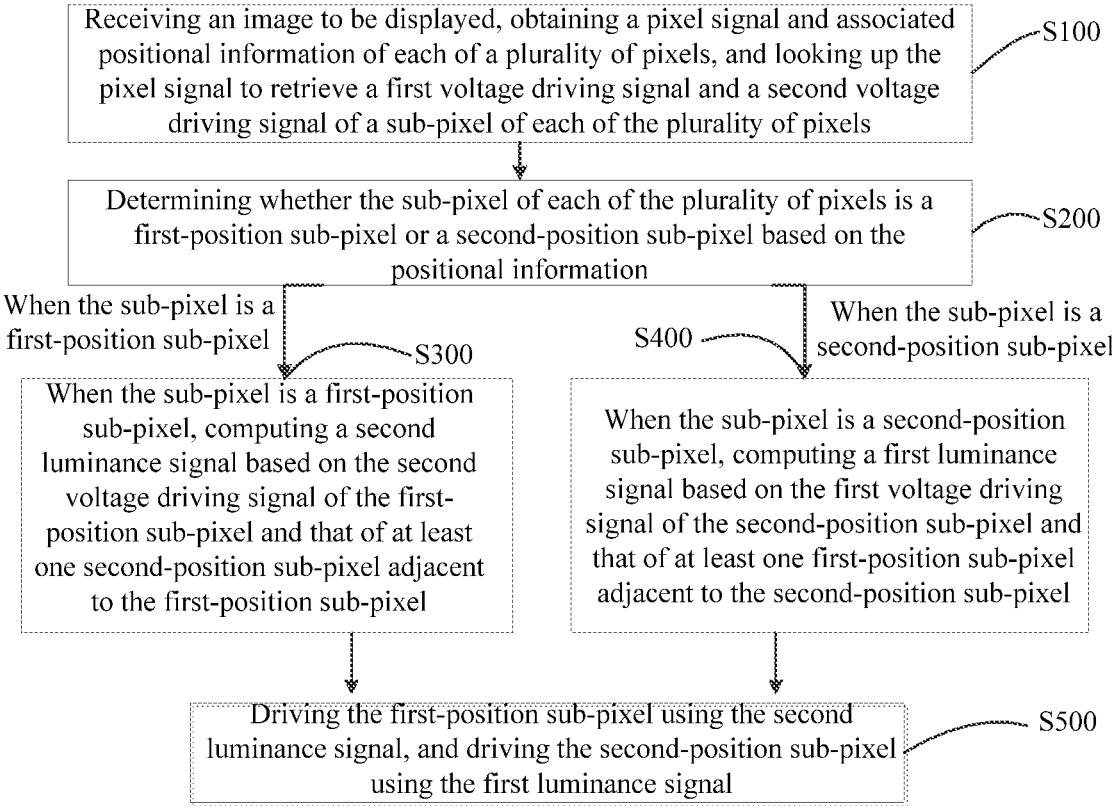
FIG. 1 is an illustrative flowchart of an embodiment of a driving method for driving a display apparatus in accordance with this application.

FIG. 1 is an illustrative flowchart of an embodiment of a driving method for driving a display device in accordance with this application. The driving method includes: S100, receiving an image to be displayed, obtaining a pixel signal and associated positional information of each of a plurality of pixels, and looking up the pixel signal to retrieve a first voltage driving signal and a second voltage driving signal of a sub-pixel of each of the plurality of pixels; S200, determining whether the sub-pixel of each of the plurality of pixels is a first-position sub-pixel or a second-position sub-pixel based on the positional information; S300, when the sub-pixel is a first-position sub-pixel, computing a second luminance signal based on the second voltage driving signal of the first-position sub-pixel and that of at least one second-position sub-pixel adjacent to the first-position sub-pixel; S400, otherwise when the sub-pixel is a second-position sub-pixel, computing a first luminance signal based on the first voltage driving signal of the second-position sub-pixel and that of at least one first-position sub-pixel adjacent to the second-position sub-pixel; and S500, driving the first-position sub-pixel using the second luminance signal, and driving the second-position sub-pixel using the first luminance signal.

An image of a display apparatus usually consists of a plurality of pixels, which forms an N by M table (N rows, M columns), and there are N*M pixels in total. Each pixel includes three sub-pixels of red (R), green (G), blue (B). Therefore, each pixel is composed of the three sub-pixels of the RGB colors, and a display color of each image pixel is a combination of corresponding display colors of the three sub-pixels. A color of each sub-pixel is determined by a grey-scale value of the sub-pixel, and the grey-scale value is determined by a driving voltage signal of the sub-pixel.

A second voltage driving signal $R_H/G_H/B_H$ and a first voltage driving signal $R_L/G_L/B_L$ are a preset second voltage driving signal and a preset voltage driving signal respectively, according to a luminance value of RGB signal input signal, which is based on a need to compensate for an visual angle effect. Furthermore, relevant data has been recorded into the display apparatus during a production process of the display apparatus. In generally, the relevant data is recorded in a hardware buffer by LUT (look up table). Taking an 8 bit driving signal as an example, a range of each R/G/B input signal value is from 0 to 255, and a number of the second voltage driving signal and a number of the first voltage driving signal are both 256, that is, there are 3*256 pairs of the second voltage driving signal $R_H/G_H/B_H$ and the first voltage driving signal $R_L/G_L/B_L$.

Referring to FIG. 3, there's shown luminance values of a part of R sub-pixels in a pixel image, where R1 to R100 represent the luminance value of 100 R sub-pixels. The second voltage driving signal value H1-H100 of each R sub-pixel of FIG. 4 and the first voltage driving signal value L1-L100 of each R sub-pixel of FIG. 5 are respectively obtained by looking up the R sub-pixel luminance values in FIG. 3 in a table. Taking a distribution of R sub-pixels as an example, according to a positional relationship between rows and columns of each of the sub-pixels, the sub pixels may be divided into first-position sub-pixels and second-position sub-pixels, the first-position sub-pixels and the second-position sub-pixels are adjacent to each other with a stagger interval, that is, there are four first-position sub-pixels adjacent to each second-position sub-pixel, and there are four second-position sub-pixels adjacent to each first-position sub-pixel.

For example, if sub-pixels on two upper rows of the panel are divided into first-position sub-pixels and second-position sub-pixels, the first-position sub-pixels are R1, R3, R5, R7, R9, R12, R14, R16, R18 and R20, and second-position sub-pixels are R2, R4, R6, R8, R10, R11, R13, R15, R17 and R19. It is evident that the first-position sub-pixels and the second-position sub-pixels are adjacent to each other with a stagger interval. Similarly, the remaining pixels can be divided into first-position sub-pixels and second-position sub-pixels. In summary, when a sub-pixel $R_{nm}$ in a position of nth row and mth column is the second position sub-pixel, then the four first position sub-pixels adjacent thereto are $R_{n(m-1)}$, $R_{n(m+1)}$, $R_{(n-1)m}$, and $R_{(n+1)m}$, respectively. Otherwise, when a sub-pixel $R_{nm}$ is in a position of nth row and mth column is the first position sub-pixel, then the four second position sub-pixels adjacent thereto are $R_{n(m-1)}$, $R_{n(m+1)}$, $R_{(n-1)m}$, and $R_{(n+1)m}$, respectively.

Referring now to FIG. 5, taking a first driving voltage value L24 corresponding to a sub-pixel R24 that belongs to the second position as an example, the four same-color sub-pixels that are adjacent to the sub-pixel R24 and that belong to the first position are R14, R23, R25, and R34, respectively, then corresponding first voltage driving values are L14, L23, L25, and L34, respectively. Therefore, a first luminance signal value L'24 can be computed using the following formula:

$$L'_{nm}=a*L_{nm}+b*(L_{n(m-1)}+L_{n(m+1)}+L_{(n-1)m}+L_{(n+1)m});$$

where n is 2 and m is 4, which may be substituted into the above formula:

$$L'24=a*L24+b*(L23+L25+L14+L34)$$

where a and b represent weight factors, the weight factor a has a value of 1 and the weight factor b has a value of 0.25; these weight factors are obtained through experiments. Then 1 and 0.25 are substituted into the above formula:

$$L'24=L24+0.25*(L14+L23+L25+L34)$$

That is, when in computing the first luminescence signal value L'24 of the second sub-pixel R24, in addition to its own first driving voltage value, the first voltage driving value of the four same-color sub-pixels R14, R23, R25, and R34 which are adjacent to the second sub-pixel R24 are also taken into account, and given a corresponding weight. In the above formula, the weight of each of the adjacent four same-color sub-pixels is 0.25. And the luminescence signal value L'24 acts as a first gray-scale luminescence value to control a color display of the sub-pixels. The above is to obtain the first luminance signal value by taking the R sub-pixel as an example. Similarly, the G sub-pixel and the B sub-pixel can obtain the first luminance signal value by the same method.

Referring now to FIG. 4, taking a second driving voltage value H14 corresponding to a sub-pixel R14 that belongs to the first position as an example, the four same-color sub-pixels that are adjacent to the sub-pixel R14 and that belong to the first position are R4, R13, R15, and R24, respectively, then corresponding second voltage driving values are H4, H13, H15, and H24, respectively. Therefore, a second luminance signal value H'14 can be computed using the following formula:

$$H'_{nm}=a*H_{nm}+b*(H_{n(m-1)}+H_{n(m+1)}+H_{(n-1)m}+H_{(n+1)m});$$

where n is 1 and m is 4, which may be substituted into the above formula:

$$H'14=a*H14+b*(H4+H13+H15+H24)$$

where a and b represent weight factors, the weight factor a has a value of 1 and the weight factor b has a value of 0.25;

these weight factors are obtained through experiments. Then 1 and 0.25 are substituted into the above formula:

$$H'14=H14+0.25*(H4+H13+H15+H24)$$

That is, when in computing the second luminescence signal value H'14 of the first sub-pixel R14, in addition to its own first driving voltage value, the second voltage driving value of the four same-color sub-pixels R4, R13, R15, and R24 which are adjacent to the second sub-pixel R14 are also taken into account, and given a corresponding weight. In the above formula, the weight of each of the adjacent four same-color sub-pixels is 0.25. The luminescence signal value H'14 acts as a first gray-scale luminescence value to control a color display of the sub-pixels.

After obtaining the second luminescence signal value and the first luminescence signal value, the corresponding pixels are adjacent to each other with a stagger interval, as illustrated in FIG. 6. It can be seen in FIG. 6 that the sub-pixels of the second luminescence signal value and the sub-pixels of the first luminescence signal value are adjacent to each other with a stagger interval, controlling the corresponding sub-pixels of the second luminescence signal value and the sub-pixels the first luminescence signal value displayed in a same frame.

It should be note that in an application process of computing the first luminescence signal value of the second position sub-pixels and the second luminescence signal value of the first position sub-pixels, when calculating luminescence signal values of each of a plurality of pixels in outermost rows and columns of a panel, some pixels may not exist, in this case, the corresponding first voltage driving signal or second voltage driving signal of the non-existent pixel position would be written as 0. For example, when calculating the second luminescence signal value of the first position sub-pixel R1, since sub-pixels adjacent to a left and a top of the first position sub-pixel R1 do not exist, then second voltage driving signals $L_{(n-1)m}$ and $L_{n(m-1)}$ are written as 0.

In this embodiment, by receiving an image to be displayed, obtaining a pixel signal and associated positional information of each of a plurality of pixels, and looking up the pixel signal to retrieve a first voltage driving signal and a second voltage driving signal of a sub-pixel of each of the plurality of pixels; determining whether the sub-pixel of each of the plurality of pixels is a first-position sub-pixel or a second-position sub-pixel based on the positional information; furthermore, when the sub-pixel is a first-position sub-pixel, computing a second luminance signal based on the second voltage driving signal of the first-position sub-pixel and that of at least one second-position sub-pixel adjacent to the first-position sub-pixel; otherwise when the sub-pixel is a second-position sub-pixel, computing a first luminance signal based on the first voltage driving signal of the second-position sub-pixel and that of at least one first-position sub-pixel adjacent to the second-position sub-pixel; and driving the first-position sub-pixel using the second luminance signal, and driving the second-position sub-pixel using the first luminance signal. Controlling the sub-pixels displayed in a same frame. Since a second luminance signal value or a first luminance signal value of four adjacent sub-pixels are taken into account when in computing a second luminance signal value or a first luminance signal value, so that the angular color shift can be solved and that the image resolution is also taken into account. In addition, technical solutions according to this application don't need to set primary pixels and secondary pixels, so there is no need to dispose metal wires or thin film transistors to drive the secondary pixels, thereby simplifying the production process and reducing the costs. The panel's transmittance is also improved due to the elimination of the secondary pixels.

Figure 2:
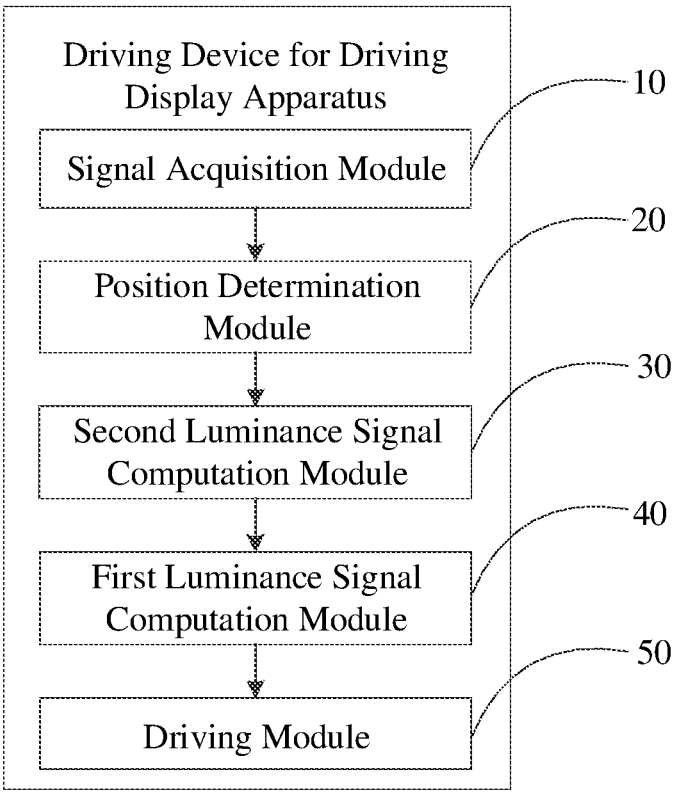
FIG. 2 is an illustrative block diagram of an embodiment of a driving device for driving a display apparatus in accordance with this application.

There is still further disclosed a driving device for driving a display apparatus based on the driving method for driving the display apparatus. FIG. 2 is an illustrative block diagram of an embodiment of a driving device for driving a display apparatus in accordance with this application. The driving device includes: a signal acquisition module 10 configured to receive an image to be displayed, obtain a pixel signal and associated positional information of each of a plurality of pixels, and look up the pixel signal to retrieve a first voltage driving signal and a second voltage driving signal of a sub-pixel of each of the plurality of pixels; a position determination module 20 configured to determine whether the sub-pixel of each of the plurality of pixels is a first-position sub-pixel or a second-position sub-pixel based on the positional information; a second luminance signal computation module 30 configured to compute, when the sub-pixel is a first-position sub-pixel, a second luminance signal based on the second voltage driving signal of the first-position sub-pixel and that of at least one second-position sub-pixel adjacent to the first-position sub-pixel; a first luminance signal computation module 40 configured to compute, when the sub-pixel is a second-position sub-pixel, a first luminance signal based on the first voltage driving signal of the second-position sub-pixel and that of at least one first-position sub-pixel adjacent to the second-position sub-pixel; and a driving module 50 configured to drive the first-position sub-pixel using the second luminance signal and drive the second-position sub-pixel using the first luminance signal.

An image of a display apparatus usually consists of a plurality of pixels, which forms an N by M table (N rows, M columns), and there are N*M pixels in total. Each pixel includes three sub-pixels of red (R), green (G), blue (B). Therefore, each pixel is composed of the three sub-pixels of the RGB colors, and a display color of each image pixel is a combination of corresponding display colors of the three sub-pixels. A color of each sub-pixel is determined by a grey-scale value of the sub-pixel, and the grey-scale value is determined by a driving voltage signal of the sub-pixel.

A second voltage driving signal $R_H/G_H/B_H$ and a first voltage driving signal $R_L/G_L/B_L$ are a preset second voltage driving signal and a preset voltage driving signal respectively, according to a luminance value of RGB signal input signal, which is based on a need to compensate for an visual angle effect. Furthermore, relevant data has been recorded into the display apparatus during the production process of the display apparatus. In generally, the relevant data is recorded in a hardware buffer by LUT (look up table). Taking an 8 bit driving signal as an example, a range of each R/G/B input signal value is from 0 to 255, and a number of the second voltage driving signal and a number of the first voltage driving signal are both 256, that is, there are 3*256 pairs of the second voltage driving signal $R_H/G_H/B_H$ and the first voltage driving signal $R_L/G_L/B_L$. Taking FIG. 3 as an example, FIG. 3 is a luminance value of a part of red R sub-pixels in a pixel image, where R1-R100 represents luminance values of 100 R sub-pixels:

The second voltage driving signal value H1-H100 of each R sub-pixel of FIG. 4 and the first voltage driving signal value L1-L100 of each R sub-pixel of FIG. 5 are respectively obtained by looking up the R sub-pixel luminance values in FIG. 3 in a table. Taking a distribution of R sub-pixels as an example, according to a positional relationship between rows and columns of each of the sub-pixels, the sub pixels may be divided into first-position sub-pixels and second-position sub-pixels, the first-position sub-pixels and the second-position sub-pixels are adjacent to each other with a stagger interval; that is, there are four first-position sub-pixels adjacent to each second-position sub-pixel, and there are four second-position sub-pixels adjacent to each first-position sub-pixel.

For example, if sub-pixels on upper two rows of the panel are divided into first-position sub-pixels and second-position sub-pixels, the first-position sub-pixels are R1, R3, R5, R7, R9, R12, R14, R16, R18 and R20, and second-position sub-pixels are R2, R4, R6, R8, R10, R11, R13, R15, R17 and R19. It is evident that the first-position sub-pixels and the second-position sub-pixels are adjacent to each other with a stagger interval. Similarly, the remaining pixels can be divided into first-position sub-pixels and second-position sub-pixels. In summary, when a sub-pixel $R_{nm}$ in a position of nth row and mth column is the second position sub-pixel, then the four first position sub-pixels adjacent thereto are $R_{n(m-1)}$, $R_{n(m+1)}$, $R_{(n-1)m}$, and $R_{(n+1)m}$, respectively. Otherwise, when a sub-pixel $R_{nm}$ in a position of nth row and mth column is the first position sub-pixel, then the four second position sub-pixels adjacent thereto are $R_{n(m-1)}$, $R_{n(m+1)}$, $R_{(n-1)m}$, and $R_{(n+1)m}$, respectively.

Referring to FIG. 5, taking a first driving voltage value L24 corresponding to a sub-pixel R24 that belongs to the second position as an example, the four same-color sub-pixels which adjacent to the sub-pixel R24 and belong to the first position are R14, R23, R25, and R34, respectively, then corresponding first voltage driving values are L14, L23, L25, and L34, respectively. Therefore, a first luminance signal value L'24 can be computed using the following formula:

$$L'_{nm}=a*L_{nm}+b*(L_{n(m-1)}+L_{n(m+1)}+L_{(n-1)m}+L_{(n+1)m});$$

where n is 2 and m is 4, which may be substituted into the above formula:

$$L'24=a*L24+b*(L23+L25+L14+L34);$$

where a and b represent weight factors, the weight factor a has a value of 1 and the weight factor b has a value of 0.25; these weight factors are obtained through experiments. Then 1 and 0.25 are substituted into the above formula:

$$L'24=L24+0.25*(L14+L23+L25+L34);$$

That is, when in computing the first luminescence signal value L'24 of the second sub-pixel R24, in addition to its own first driving voltage value, the first voltage driving value of the four same-color sub-pixels R14, R23, R25, and R34 which are adjacent to the second sub-pixel R24 are also taken into account, and given a corresponding weight. In the above formula, the weight of the adjacent four same-color sub-pixels is 0.25. And the luminescence signal value L'24 acts as a first gray-scale luminescence value to control a color display of the sub-pixels. The above is to obtain the first luminance signal value by taking the R sub-pixel as an example. Similarly, the G sub-pixel and the B sub-pixel can obtain the first luminance signal value by the same method.

Referring to FIG. 4, taking a second driving voltage value H14 corresponding to a sub-pixel R14 that belongs to the first position as an example, the four same-color sub-pixels which adjacent to the sub-pixel R14 and belong to the first position are R4, R13, R15, and R24, respectively, then corresponding second voltage driving values are H4, H13, H15, and H24, respectively. Therefore, a second luminance signal value H'14 can be computed using the following formula:

$$H'_{nm}=a*H_{nm}+b*(H_{n(m-1)}+H_{n(m+1)}+H_{(n-1)m}+H_{(n+1)m});$$

where n is 1 and m is 4, which may be substituted into the above formula:

$$H'14=a*H14+b*(H4+H13+H15+H24);$$

where a and b represent weight factors, the weight factor a has a value of 1 and the weight factor b has a value of 0.25 which are obtained through experiments, and then 1 and 0.25 are substituted into the above formula:

$$H'14=H14+0.25*(H4+H13+H15+H24)$$

That is, when in computing the second luminescence signal value H'14 of the first sub-pixel R14, in addition to its own first driving voltage value, the second voltage driving value of the four same-color sub-pixels R4, R13, R15, and R24 which are adjacent to the second sub-pixel R14 are also taken into account, and given a corresponding weight. In the above formula, the weight of the adjacent four same-color sub-pixels is 0.25. And the luminescence signal value H'14 is acted as a first gray-scale luminescence value to control a color display of the sub-pixels.

After obtaining the second luminescence signal value and the first luminescence signal value, the corresponding pixels are adjacent to each other with a stagger interval, as shown in FIG. 6. It can be seen in FIG. 6 that the sub-pixels of the second luminescence signal value and the sub-pixels of the first luminescence signal value are adjacent to each other with a stagger interval, controlling the corresponding sub-pixels of the second luminescence signal value and the sub-pixels the first luminescence signal value displayed in a same frame.

It should be note that in an application process of computing the first luminescence signal value of the second position sub-pixels and the second luminescence signal value of the first position sub-pixels, when calculating luminescence signal values of each of a plurality of pixels in outermost rows and columns of a panel, some pixels may not exist, in this case, the corresponding first voltage driving signal or second voltage driving signal of the non-existent pixel position would be written as 0. For example, when calculating the second luminescence signal value of the first position sub-pixel R1, science sub-pixels adjacent to a left and a top of the first position sub-pixel R1 are not exist, then second voltage driving signals $L_{(n-1)m}$ and $L_{n(m-1)}$ are written as 0.

In this embodiment, by receiving an image to be displayed, obtaining a pixel signal and associated positional information of each of a plurality of pixels, and looking up the pixel signal to retrieve a first voltage driving signal and a second voltage driving signal of a sub-pixel of each of the plurality of pixels; determining whether the sub-pixel of each of the plurality of pixels is a first-position sub-pixel or a second-position sub-pixel based on the positional information; furthermore, when the sub-pixel is a first-position sub-pixel, computing a second luminance signal based on the second voltage driving signal of the first-position sub-pixel and that of at least one second-position sub-pixel adjacent to the first-position sub-pixel; otherwise when the sub-pixel is a second-position sub-pixel, computing a first luminance signal based on the first voltage driving signal of the second-position sub-pixel and that of at least one first-position sub-pixel adjacent to the second-position sub-pixel; and driving the first-position sub-pixel using the second luminance signal, and driving the second-position sub-pixel using the first luminance signal. Controlling the sub-pixels displayed in a same frame. Since a second luminance signal value or a first luminance signal value of four adjacent sub-pixels are taken into account when in computing a second luminance signal value or a first luminance signal value, the angular color shift is solved and the image resolution is also taken into account. In addition, technical solutions according to this application don't need to set primary pixels and secondary pixels, so there is no need to dispose metal wires or thin film transistors to drive the secondary pixels, thereby simplifying the production process and reducing the costs. The panel's transmittance is also improved due to the elimination of the secondary pixels.

Figure 7:
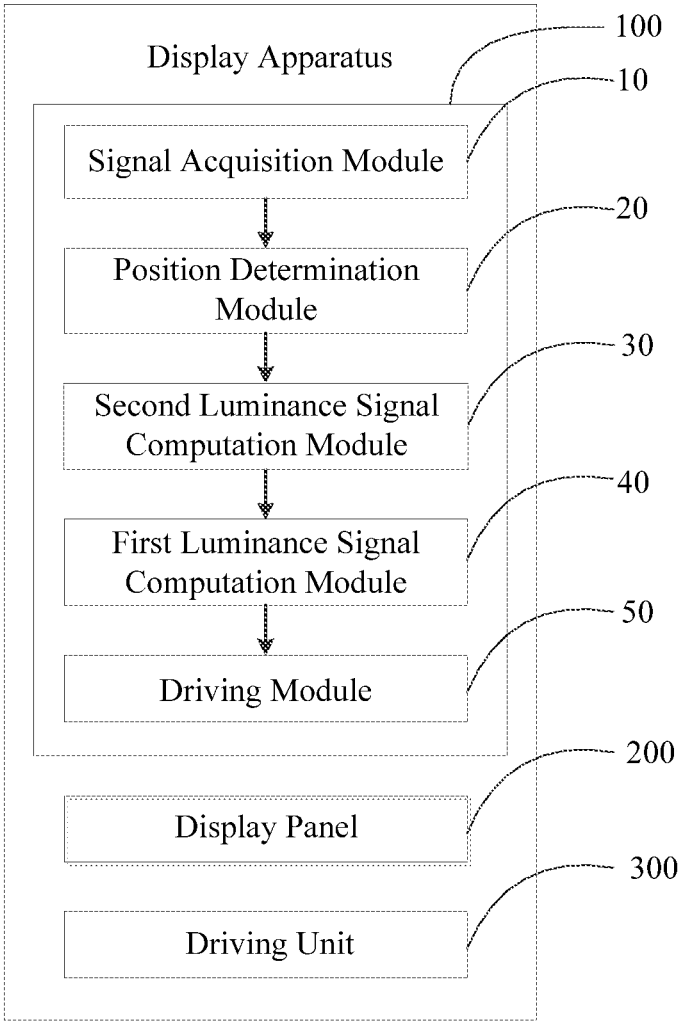
FIG. 7 is an illustrative block diagram of an embodiment of a display apparatus in accordance with this application.

Referring to FIG. 7, there is still further disclosed a display apparatus, the driving apparatus includes a driving device, a display panel 200, and a driving unit 300 for driving the display device. A specific structure of the driving device of the display device is as described above with reference to the above embodiments. Science the display device adopts all technical solutions of the foregoing embodiments, at least all the beneficial effects brought by the technical solutions of the foregoing embodiments which have been described previously are achieved, and full details will not be given again.

The display device may be a table computer display, a television display, a computer display, and the like.

The foregoing description merely depicts some illustrative embodiments of this disclosure and therefore is not intended to limit the scope of this disclosure. Any equivalent structural or flow changes made by using the contents of the specification and drawings of this disclosure, or any direct or indirect applications of this disclosure on any other related fields shall all fall in the scope of this disclosure.

What is claimed is:

1. A driving method for driving a display apparatus, comprising:

receiving, by a processing module, an image to be displayed, obtaining a pixel signal and associated positional information of each of a plurality of pixels, and looking up the pixel signal to retrieve a first voltage driving signal and a second voltage driving signal of a sub-pixel of the pixel;

determining whether the sub-pixel of each of the plurality of pixels is a first-position sub-pixel or a second-position sub-pixel based on the positional information;

when the sub-pixel is a first-position sub-pixel, computing a second luminance signal based on the second voltage driving signal of the first-position sub-pixel and the second voltage driving signal of at least one second-position sub-pixel adjacent to the first-position sub-pixel;

otherwise when the sub-pixel is a second-position sub-pixel, computing a first luminance signal based on the first voltage driving signal of the second-position sub-pixel and the first voltage driving signal of at least one first-position sub-pixel adjacent to the second-position sub-pixel; and driving the first-position sub-pixel using the second luminance signal, and driving the second-position sub-pixel using the first luminance signal, wherein computing the first luminance signal when the sub-pixel is a second-position sub-pixel comprises substituting relevant parameters into the following formula to compute the first luminance signal;

$$L'_{nm}=a*L_{nm}+b*(L_{n(m-1)}+L_{n(m+1)}+L_{(n-1)m}+L_{(n+1)m});$$

where n represents row position information of the second-position sub-pixel in a panel, m represents column position information of the second-position sub-pixel in the panel, and a and b represent weight factors; $L_{nm}$ and $L'_{nm}$ respectively represent the first voltage driving signal and the first luminance signal of the second-position sub-pixel; and $L_{n(m-1)}$, $L_{n(m+1)}$, $L_{(n-1)m}$, and $L_{(n+1)m}$ respectively represent first voltage driving signals of the first-position sub-pixels adjacent to the second-position sub-pixel.

2. The driving method of claim 1, wherein computing the second luminance signal when the sub-pixel is a first-position sub-pixel comprises substituting relevant parameters into the following formula to compute the second luminance signal;

$$H'_{nm}=a*H_{nm}+b*(H_{n(m-1)}+H_{n(m+1)}+H_{(n-1)m}+H_{(n+1)m});$$

where n represents row position information of the first-position sub-pixel in a panel, m represents column position information of the first-position sub-pixel in the panel, and a and b represent weight factors; $H_{nm}$ and $H'_{nm}$ respectively represent the second voltage driving signal and the second luminance signal of the first-position sub-pixel; and $H_{n(m-1)}$, $H_{n(m+1)}$, $H_{(n-1)m}$, and $H_{(n+1)m}$ respectively represent second voltage driving signals of the second-position sub-pixels adjacent to the first-position sub-pixel.

3. The driving method of claim 1, wherein the weight factor a has a value of 1, and the weight factor b has a value of 0.25.

4. The driving method of claim 1, further comprising:

when in computing the first luminance signal or the second luminance signal using the formula a corresponding pixel position of the first-position sub-pixel or the second-position sub-pixel in the formula doesn't exist in the panel, writing the corresponding first voltage driving signal or second voltage driving signal of the non-existent pixel position as 0.

5. A driving device for driving a display apparatus, the driving device comprising a storage module storing one or more executable instructions and a proccessor configured to execute the one or more executable instructions to perform operations of a driving method for driving the display apparatus, the method comprising:

receiving, by a processing module, an image to be displayed, obtaining a pixel signal and associated positional information of each of a plurality of pixels, and looking up the pixel signal to retrieve a first voltage driving signal and a second voltage driving signal of a sub-pixel of the pixel;

determining whether the sub-pixel of each of the plurality of pixels is a first-position sub-pixel or a second-position sub-pixel based on the positional information;

when the sub-pixel is a first-position sub-pixel, computing a second luminance signal based on the second voltage driving signal of the first-position sub-pixel and the second voltage driving signal of at least one second-position sub-pixel adjacent to the first-position sub-pixel;

otherwise when the sub-pixel is a second-position sub-pixel, computing a first luminance signal based on the first voltage driving signal of the second-position sub-pixel and the first voltage driving signal of at least one first-position sub-pixel adjacent to the second-position sub-pixel; and driving the first-position sub-pixel using the second luminance signal, and driving the second-position sub-pixel using the first luminance signal, wherein computing the first luminance signal when the sub-pixel is a second-position sub-pixel comprises substituting relevant parameters into the following formula to compute the first luminance signal;

$$L'_{nm}=a*L_{nm}+b*(L_{n(m-1)}+L_{n(m+1)}+L_{(n-1)m}+L_{(n+1)m});$$

where n represents row position information of the second-position sub-pixel in a panel, m represents column position information of the second-position sub-pixel in the panel, and a and b represent weight factors; $L_{nm}$ and $L'_{nm}$ respectively represent the first voltage driving signal and the first luminance signal of the second-position sub-pixel; and $L_{n(m-1)}$, $L_{n(m+1)}$, $L_{(n-1)m}$, and $L_{(n+1)m}$ respectively represent first voltage driving signals of the first-position sub-pixels adjacent to the second-position sub-pixel.

6. The driving device of claim 5, wherein the weight factor a has a value of 1, and the weight factor b has a value of 0.25.

7. The driving device of claim 5, wherein computing the second luminance signal when the sub-pixel is a first-position sub-pixel comprises substituting relevant parameters into the following formula to compute the second luminance signal;

$$H'_{nm}=a*H_{nm}+b*(H_{n(m-1)}+H_{n(m+1)}+H_{(n-1)m}+H_{(n+1)m});$$

where n represents row position information of the first-position sub-pixel in a panel, m represents column position information of the first-position sub-pixel in the panel, and a and b represent weight factors; $H_{nm}$ and $H'_{nm}$ respectively represent the second voltage driving signal and the second luminance signal of the first-position sub-pixel; and $H_{n(m-1)}$, $H_{n(m+1)}$, $H_{(n-1)m}$, and $H_{(n+1)m}$ respectively represent second voltage driving signals of the second-position sub-pixels adjacent to the first-position sub-pixel.

8. The driving device of claim 5, wherein the method further comprises: when in computing the first luminance signal or the second luminance signal a corresponding pixel position of the first-position sub-pixel or the second-position sub-pixel in the formula doesn't exist in the panel, the corresponding first voltage driving signal or second voltage driving signal of the non-existent pixel position is written as 0.

9. A display apparatus, comprising:

a display panel;

a driving unit; and the driving device of claim 5 for driving a display apparatus, the driving device comprising a storage module storing one or more executable instructions and a proccessor configured to execute the one or more executable instructions to perform operations of a driving method for driving the display apparatus, the method comprising:

receiving, by a processing module, an image to be displayed, obtaining a pixel signal and associated positional information of each of a plurality of pixels, and looking up the pixel signal to retrieve a first voltage driving signal and a second voltage driving signal of a sub-pixel of the pixel;

determining whether the sub-pixel of each of the plurality of pixels is a first-position sub-pixel or a second-position sub-pixel based on the positional information;

when the sub-pixel is a first-position sub-pixel, computing a second luminance signal based on the second voltage driving signal of the first-position sub-pixel and the second voltage driving signal of at least one second-position sub-pixel adjacent to the first-position sub-pixel;

otherwise when the sub-pixel is a second-position sub-pixel, computing a first luminance signal based on the first voltage driving signal of the second-position sub-pixel and the first voltage driving signal of at least one first-position sub-pixel adjacent to the second-position sub-pixel; and driving the first-position sub-pixel using the second luminance signal, and driving the second-position sub-pixel using the first luminance signal, wherein computing the first luminance signal when the sub-pixel is a second-position sub-pixel comprises substituting relevant parameters into the following formula to compute the first luminance signal;

$$L'_{nm}=a*L_{nm}+b*(L_{n(m-1)}+L_{n(m+1)}+L_{(n-1)m}+L_{(n+1)m});$$

where n represents row position information of the second-position sub-pixel in a panel, m represents column position information of the second-position sub-pixel in the panel, and a and b represent weight factors; $L_{nm}$ and $L'_{nm}$ respectively represent the first voltage driving signal and the first luminance signal of the second-position sub-pixel; and $L_{n(m-1)}$, $L_{n(m+1)}$, $L_{(n-1)m}$, and $L_{(n+1)m}$ respectively represent first voltage driving signals of the first-position sub-pixels adjacent to the second-position sub-pixel.

10. The display apparatus of claim 9, wherein the weight factor a has a value of 1, and the weight factor b has a value of 0.25.

11. The display apparatus of claim 9, wherein computing the second luminance signal when the sub-pixel is a first-position sub-pixel comprises substituting relevant parameters into the following formula to compute the second luminance signal;

$$H'_{nm}=a*H_{nm}+b*(H_{n(m-1)}+H_{n(m+1)}+H_{(n-1)m}+H_{(n+1)m});$$

where n represents row position information of the first-position sub-pixel in a panel, m represents column position information of the first-position sub-pixel in the panel, and a and b represent weight factors; $H_{nm}$ and $H'_{nm}$ respectively represent the second voltage driving signal and the second luminance signal of the first-position sub-pixel; and $H_{n(m-1)}$, $H_{n(m+1)}$, $H_{(n-1)m}$, and $H_{(n+1)m}$ respectively represent second voltage driving signals of the second-position sub-pixels adjacent to the first-position sub-pixel.

12. The display apparatus of claim 9, wherein the method further comprises: when in computing the first luminance signal or the second luminance signal a corresponding pixel position of the first-position sub-pixel or the second-position sub-pixel in the formula doesn't exist in the panel, the corresponding first voltage driving signal or second voltage driving signal of the non-existent pixel position is written as 0.

* * * * *